US005099746A

United States Patent [19]

Gustavsson et al.

[11] Patent Number: 5,099,746

[45] Date of Patent: Mar. 31, 1992

[54] METHOD AND DEVICE FOR DISCOVERING AND DESTRUCTING SUBMARINE VESSELS FROM AN AIRCRAFT

[75] Inventors: Mats Gustavsson; Jan Olsson; Thord Olsson, all of Landskrona, Sweden

[73] Assignee: SA Marine AB, Sweden

[21] Appl. No.: 659,394

[22] PCT Filed: Jul. 11, 1989

[86] PCT No.: PCT/SE89/00403

§ 371 Date: Feb. 21, 1991

§ 102(e) Date: Feb. 21, 1991

[87] PCT Pub. No.: WO90/00715

PCT Pub. Date: Jan. 25, 1990

[51] Int. Cl.[5] ..... F42B 19/46; G01S 9/68

[52] U.S. Cl. ..... 89/1.11; 114/21.2; 367/133

[58] Field of Search ..... 89/1.11; 367/133; 114/21.1, 21.2, 21.3

[56] References Cited

U.S. PATENT DOCUMENTS

| | | | |
|---|---|---|---|
| 3,161,168 | 12/1964 | Rebikoff | 114/21.1 |
| 3,526,198 | 9/1970 | Mathes et al. | 114/20.1 |
| 3,783,441 | 1/1974 | Slawsky | 114/21.2 |
| 4,372,239 | 2/1983 | Hagelberg et al. | 367/133 |
| 4,473,896 | 9/1984 | Loeser et al. | 367/131 |
| 4,989,530 | 2/1991 | Thompson et al. | 114/21.3 |

*Primary Examiner*—David H. Brown

*Attorney, Agent, or Firm*—Gunn, Lee & Miller

[57] ABSTRACT

The invention relates to a method for locating and destructing submarine vehicles from airborne vehicles disposed above the water surface, wherein a device (10) suspended from said airborne vehicle comprises sensing means (14) scanning generally in the horizontal plane to discover submarine vehicles in the water is submerged in the water from the airborne vehicle, said sensing means scanning the surrounding water to detect presence of and direction to submarine vehicles in the water. The device submerged in the water comprises a propulsion mechanism (12) and an explosive charge (11) and is released from the airborne vehicle during continuous scanning of the water and detection of the presence of an direction to submarine vehicles is propelled independently through the water and steered for the submarine vehicle from the point of release.

2 Claims, 1 Drawing Sheet

Figure 1:
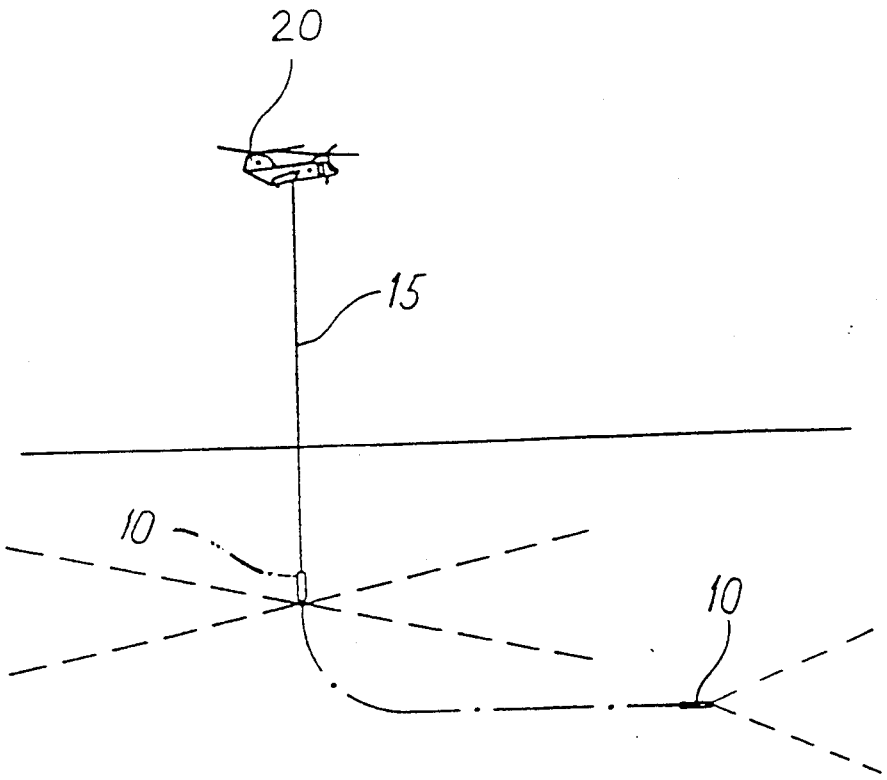

METHOD AND DEVICE FOR DISCOVERING AND DESTRUCTING SUBMARINE VESSELS FROM AN AIRCRAFT

The invention relates to method and device for locating and destructing submarine vehicles from airborne vehicles disposed above the water surface, the airborne vehicle being connected to the device comprising sensing means sensing generally in the horizontal plane to discover submarine vehicles in the water, and being lowered down into the water from the airborne vehicle, the sensing means sensing the surrounding water to register presence and direction of submarine vehicles in the water.

Location and destruction of submarine vehicles take place from the air, the water and the water surface. From the air the hunting of submarine vehicles is normally done by means of helicopter which, after discovering and locating the target, launch one or several depth charges to the target. It is also possible to utilize airplanes to hunt the submarine vehicles. The major advantage with airbased weapon systems is their ability to cover large areas and their ability to move fast to the present search area. In the water other submarine vehicles are an efficient weapon especially for reconnaissance, if the distance between the submarine vehicles is small to start with. The perhaps most efficient fighting of submarine vehicles is that from the water surface because a high capability in watching can be combined with carrying large amounts of arms. The time of transport between the vehicle camp and the fighting area as with submarine vehicles is the main disadvantage.

Normally hydrophone elements are utilized to detect submarine vehicles, said elements being active or passive. An active hydrophone element emits sound pulses in the water and receives the sound pulses reflected on various objects in the water. A passive hydrophone element only listens for sounds generated by a submarine vehicle.

As for water vehicles the hydrophone element is normally arranged in the hull of the vehicle, which as to helicopters the hydrophone element is lowered from the helicopter hovering above the water surface. When airplanes are being utilized in detecting submarine vehicles normally other types of detection means such as heat sensitive cameras, radar and the like are utilized. When the submarine vehicle has been located it is first of all decided if the use of weapons is appropriate with reference among other things to hit probability and risks. Preferably the decision is made by personnel on the arms carrying vehicle. When the fighting is done by helicopters the use of weapons normally takes place from other helicopters than the watching helicopter or helicopters.

The most common type of weapon in fighting submarine vehicles is depth charges which are detonated at adjustable levels or at direct or magnetic contact with the submarine vehicle. The most simple type of depth charges completely lacks a propulsion means of its own and falls towards the bottom of the sea when launched from airborne vehicles or surface vehicles. More developed types of depth charges comprise also a hydrophone element and some type of steering means e.g. a rudder which during the course of fall steers the depth charge towards the target in dependence of the sound impulses received in said hydrophone element. Further developed depth charges are also provided with propulsion means of its own.

The latter type of weapon can be compared to a type of torpedo. Also torpedoes exist as more or less advanced and complicated types. However, they all comprise some kind of sensor means so as to find out the direction of the submarine vehicle, a propulsion mechanism on their own and of course a warhead. Torpedoes can be launched from all the arms carrying systems described above.

Homing torpedoes launched from airborne or surface vehicles must as soon as possible after penetration of the water surface search surrounding water by means of the sensor means, detect the direction of the target, i.e. the submarine vehicle, and thereafter during the movement ahead steer towards the target. It is imperative that the direction is determined as soon as possible because the torpedo is of high speed when penetrating the water surface. U.S. Pat. No. 4,372,239 discloses a torpedo which is provided with a double set of sensing means so as to improve the appearance in this respect, one of the sensing means being most sensitive in the direction of the axis of the spool-shaped torpedo, and the other being most sensitive in radial direction. During the course of the torpedo sinking in the water the latter is used which substantially increases the detection possibilities. When the submarine vehicle has been located there is a switch-over to the sensing means being most sensitive in axial direction. At the same time the steering and propulsion devices of the torpedo are activated to bring it forward towards the target.

One of the main reasons even the most advanced weapon fails to reach the target is that the weapon reaches the bottom of the sea and is destroyed before it has determined the appropriate direction to the target An object with the present invention is to provide a method according to which the hit probability is substantially increased and according to which a more reliable estimation of the hit probability can be made before the weapon is used. Another object with the invention is to provide a device for carrying out the above-mentioned method.

Figure 2:
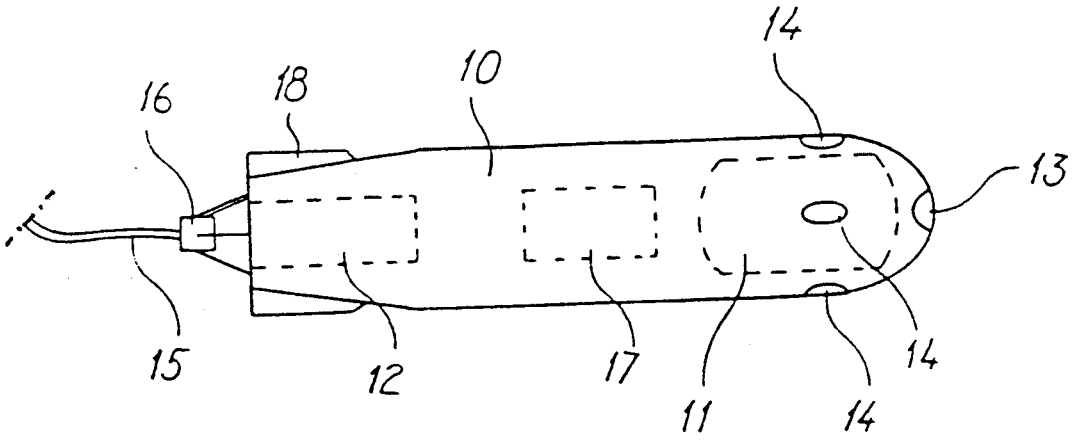

In order to explain the invention in more detail an embodiment thereof will be described with reference to the accompanying drawings, wherein FIG. 1 diagramatically shows an attack on submarine vehicles by means of the device according to the invention, and FIG. 2 is a side-view of the device according to the invention.

According to FIG. 1 the attack on submarine vehicles takes place from a helicopter 20 hovering at an appropriate distance above the water surface. From the helicopter 20 a device according to the invention is lowered under the water surface to an appropriate depth. The device is connected to the helicopter 20 through a cable 15 and comprises a generally spool shaped body 10. When a target is detected by sensor means arranged in the body 10 said body is disengaged from the cable 15 and moves towards the target. The method according to the invention will be described in more detail below, the device according to the invention being described in more detail first.

During operation the device according to the invention is connected to the helicopter 20 through a cable 15. In one embodiment of the invention the cable is a communication link between the device and the helicopter while in another embodiment it consists of a steelwire rope only. To make possible disengagement of the device from the cable 15 said cable is attached to the body 10 through a release means 16 formed as a cylindrical body comprising a minor explosive charge. When the minor explosive charge is detonated the body 10 is released very fast from the cable 15. To propel the body 10 a propulsion mechanism 12 is utilized, said mechanism being conventional or for instance a hydropulse motor according to U.S. Pat. No. 4,372,239 mentioned above. The device also comprises a central unit 17, which activates the propulsion mechanism 12, and steering means 18 in dependance of signals from different sensor means. The body 10 is provided with two sets of sensing means. A first set 4 comprises sensing means 14 equally spaced around the periphery of the spool shaped body. These sensing means 14 together provide a scanning field of approximately 360° in the horizontal plane and a search in elevation in the vertical plane of approximately 20°. Said sensing means 14 are active mainly during the search period during which the device is connected to the helicopter 20.

The forward section of the body 10 contains a sensing means 13 searching the area in the actual direction of the body 10 in front of the device with a relatively small lobe.

Also provided in the forward section of the body 10 is an explosive charge 11 of appropriate size. The explosive charge 11 is preferably detonated by means of a magnetic sensor (not shown) but can also be detonated mechanically or in other ways.

The sensing means 13 and 14 are preferably active hydrophone elements and can be constructed different from the embodiment described above. However, when carrying out the method according to the invention it is crucial that the sensing means are well functioning in a search mode in which the device is connected to the helicopter as well as in an attack mode in which the device independently moves towards the target.

The method according to the invention will now be described in more detail. According to the invention the search for marine vehicles initially is done in a conventional manner by lowering down to an appropriate depth a device comprising a hydrophone element from a helicopter. In the water the active hydrophone element emits sound impulses which are reflected on objects in the water. Signals received are processed in different ways to separate echoes from a submarine vehicle from other echoes emancipating from the bottom of the sea and other stationary objects. In conventional reconnaissance the processing mainly takes place in the helicopter. According to the present invention the processing can also be local in the device lowered down into the water. If the hydrophone element detects a submarine vehicle and the device is connected to the helicopter through a cable permitting communication therebetween a decision of fire against the object is made on the helicopter. In such a case the device is released from the cable 15 by detonating a minor explosive charge on the release means 16. The propulsion mechanism 12 is then activated and the device is accelerated towards the target. As the direction to the target constantly is known in the control unit 17 there is no risk of loosing the direction to the target during this normally critical part of the attack. The sensing means 14 but above all the sensing means 13 continuously keeps track with the submarine vehicle, thereby ensuring a very high hit probability.

If the device is connected to the helicopter 20 through a wire rope or something similar the decision of release from the connection means 15 and also of fire is made in the central unit 17. As in the case described above the direction to the target is never lost and thus the hit probability is also in this case very high.

We claim:

1. A method for discovering and destructing submarine vehicles from airborne vehicles disposed above the water surface comprising the steps of:

suspending a device from said airborne vehicle, said device further comprising:

a body member having sensing means for scanning generally in the horizontal plane to discover said submarine in said water;

a propulsion mechanism in said device for propelling said body;

a means for steering said device on said body; and an explosive charge so as to release said body from said airborne vehicle;

lowering said device into said water from said airborne vehicle;

continuously scanning the surrounding water with said sensing means to detect presence of and direction to said submarine vehicle in said water;

deciding a hit probability;

releasing said device from said airborne vehicle at a release point;

propelling said device by said propulsion mechanism through said water from said point of release; and steering independently said device toward said submarine vehicle when said submarine vehicle is discovered and when a decision of hit probability is made.

2. The method of claim 1 wherein said decision of hit probability is made on board said airborne vehicle.

* * * * *